United States Patent [19]

Jenne

[11] Patent Number: 4,480,525

[45] Date of Patent: Nov. 6, 1984

[54] CONTROL DEVICE FOR FORWARD AND BACKWARD TRAVEL OF AUTOMATIC PNEUMATIC PERCUSSION BORING DEVICES

[76] Inventor: Gustav Jenne, Schmachtenbergstrasse 183, 43 Essen-Kettwich, Fed. Rep. of Germany

[21] Appl. No.: 343,060

[22] Filed: Jan. 27, 1982

[30] Foreign Application Priority Data

Feb. 10, 1981 [DE] Fed. Rep. of Germany ..... 3104547

[51] Int. Cl.[3] ..... F15B 15/22; F01L 21/02; F01B 7/18

[52] U.S. Cl. ..... 91/25; 91/234; 91/235; 91/277; 91/321

[58] Field of Search ..... 91/234, 235, 321, 417 R, 91/277, 25; 175/19; 173/91

[56] References Cited

U.S. PATENT DOCUMENTS

| | | | |
|---|---|---|---|
| 1,050,951 | 1/1913 | Kessel | 91/234 |
| 3,026,854 | 3/1962 | Wiedmann et al. | 91/417 R |
| 3,138,066 | 6/1964 | Walker | 91/25 |
| 4,100,980 | 7/1978 | Jenne | 91/234 |
| 4,144,941 | 3/1979 | Ritter | 175/19 |
| 4,284,147 | 8/1981 | Jenne | 91/234 |

FOREIGN PATENT DOCUMENTS 2756567 1/1980 Fed. Rep. of Germany .

*Primary Examiner*—Paul E. Maslousky
*Attorney, Agent, or Firm*—Martin A. Farber

[57] ABSTRACT

A control device for working cycles of a self-propelled pneumatic boring device with a non-rotatable axially displaceable impact piston controllable by control edges of a control sleeve supported axially non-displaceably but rotatably and at its front end forming a control head with the control edges. The control head engaging in a cylindrical recess at a rear end of the impact piston cooperates with a radial main control opening formed in the impact piston in the vicinity of the recess. The control edges form two different pairs of the control edges, offset peripherally as well as axially such that respectively in one rotated position of the control sleeve only one of the pairs is aligned for cooperation with the main control opening. The impact piston is formed with at least one additional control opening which cooperates with the other pair and has a flow cross-section considerably smaller than that of the main control opening. The rear control edges of both of the pairs are formed in common by a rear circumferential edge of the control head.

10 Claims, 9 Drawing Figures

Figure 1:
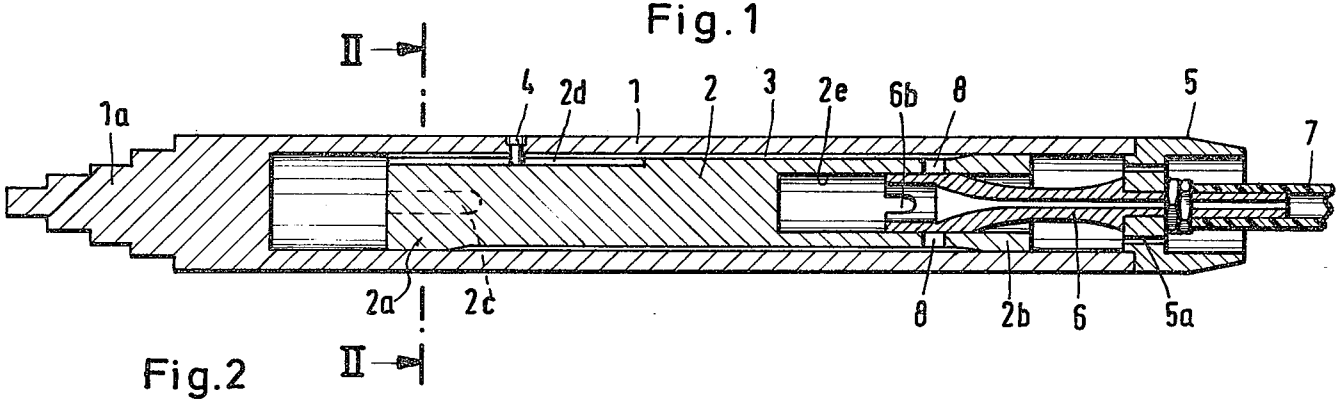

CONTROL DEVICE FOR FORWARD AND BACKWARD TRAVEL OF AUTOMATIC PNEUMATIC PERCUSSION BORING DEVICES

The present invention relates to a control device for the forward and backward movement of self-propelled pneumatic percussion boring devices having an impact piston which is axially displaceable between two abutments respectively impacting one of the abutments in each working cycle in a generally tubular housing, the compressed air being fed to said piston for its axial forward and backward movement by a control sleeve connected with a compressed air hose, which sleeve is supported in rotatable but axially non-displaceable manner on a bearing ring arranged in the rear part of the housing and has at its front end a piston-like control head which engages into a cylindrical recess on the rear end of the impact piston, the piston being guided in non-rotatable manner within the housing and being provided in the region of the cylindrical recess with at least one radial control opening which, depending on the direction of movement of the boring device cooperates with one of two pairs of control edges which are formed spaced in circumferential and longitudinal directions from each other on the control head.

Control devices of the above-described type for pneumatic ram boring devices are known from West German Provisional Patent AS No. 2 756 567 (and corresponding U.S. Pat. No. 4,284,147). They permit a reliably operating and simple reversal of the direction of movement of the pneumatic percussion boring device by simply turning the control sleeve by means of the compressed air hose.

The object of the present invention is to increase the energy of impact upon the forward movement of a percussion boring device having a control device of the afore-mentioned type, while at the same time simplifying its construction without any change in the dimensions or dimensional ratios and simultaneously reducing its consumption of energy as a result of an improvement in its efficiency.

This object is achieved in accordance with the present invention in the manner that at least one additional control opening is formed in the impact piston, cooperating at each respective time with the other of the two pairs of the control edges and its cross section of flow being considerably smaller than the main (first-mentioned) control opening, and the rear control edges of both of the two pairs of control edges being formed in common by the rear circumferential edge of the control head.

The formation of the rear control edges of the two pairs of control edges by one rear circumferential edge of the control head results not only in a simplification of the construction of the control sleeve but, in combination with the additional control opening in the impact piston, also in a change in the course of movement of the impact piston, since the backward movement of the impact piston upon the forward travel of the percussion boring device is lengthened as a result of the compressed air emerging through the additional control opening so that a longer stroke of the impact piston is obtained without changing the dimensions or dimensional relationships. For the same pressure of the compressed air fed to the percussion boring device, this longer stroke results in a higher impact velocity of the impact piston on the front end of the housing and thus in an increase in the impact energy of the percussion boring device. At the same time there is obtained a faster sequence of impacts so that the further development in accordance with the invention leads, as a whole, to a better utilization of energy by an improvement in efficiency.

The main and additional control openings of the percussion drill of the invention can be arranged in a common radial plane of the impact piston; under certain conditions, however, it may also be advantageous to stagger (offset) the position of the additional control opening axially forward or rearward with respect to the main control opening.

While in the embodiment in accordance with the invention the rear control edges of both control edge pairs are formed jointly by the rear circumferential edge of the control head, the front control edge of the control edge pair which is axially rearward (compared to the other control edge pair) is formed in known manner by a recess which extends from the forward edge of the control head. Nevertheless, the manufacture of the control sleeve is simplified, since in order to form the two pairs of control edges which are staggered in circumferential and axial directions it is merely necessary to form a recess extending from the forward edge in the piston-like control head for each main control opening.

Since this recess in the forward edge of the control head cooperates with the additional control opening upon the forward travel of the percussion boring device, it is possible, in accordance with another feature of the invention, for the forward edge of that pair of control edges which is axially rearward relative to the other pair of control edges to have one control edge section associated with the main control opening and one control edge section associated with the additional control opening, these sections being staggered axially with respect to each other so that further influence, in accordance with the invention, of the course of movement of the impact piston is possible by the axial stagger of the two control edge sections.

Figure 3:
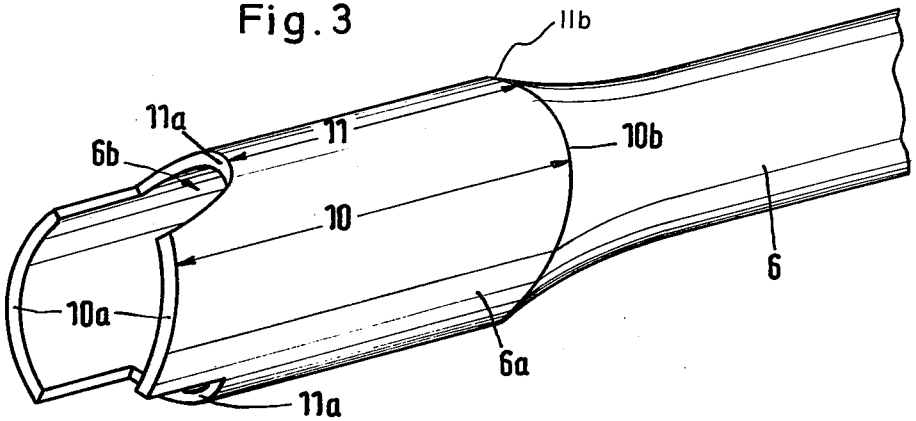
Figure 2:
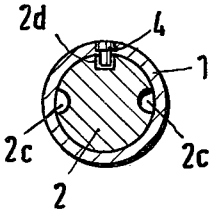
Figure 7:
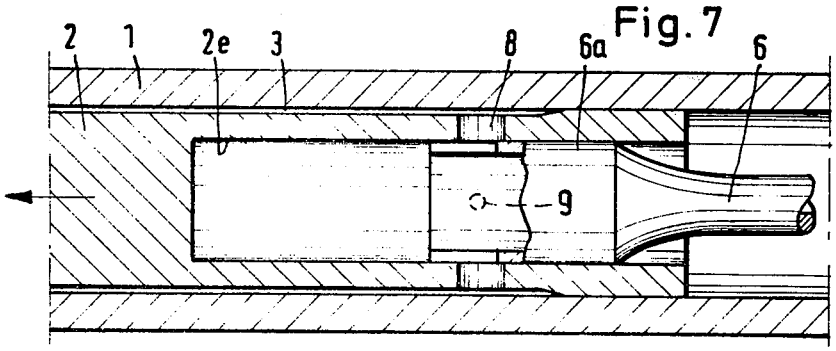
Figure 9:
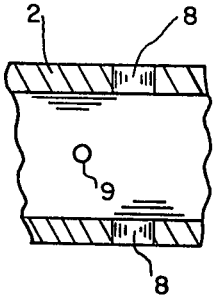
Figure 8:
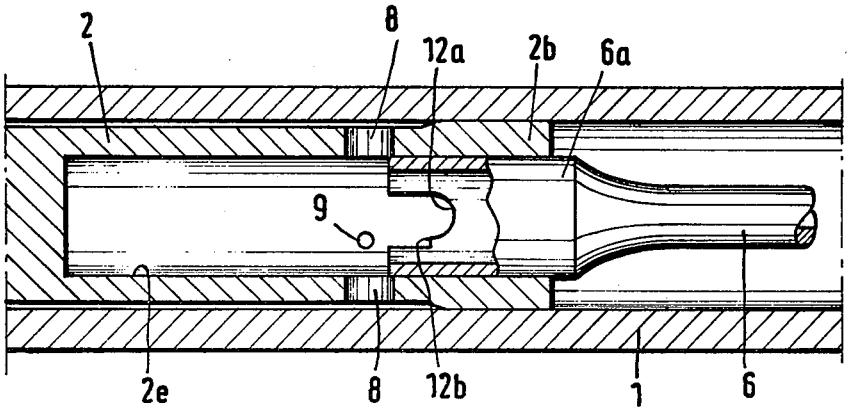

With the above and other objects and advantages in view, the present invention will become more clearly understood in connection with the detailed description of preferred embodiments, when considered with the accompanying drawings, of which:

FIG. 1 is a longitudinal section through a complete percussion boring device, FIG. 2 is a cross section along the section line II—II of FIG. 1, FIG. 3 is an isometric view of the control sleeve, on a larger scale, broken away in part, FIGS. 4 to 7 show, on a larger scale, partial longitudinal sections in the region of the control sleeve in different positions of the impact piston, FIG. 8 shows an enlarged partial section through a modified embodiment of the control sleeve, and FIG. 9 is a partial longitudinal section through another embodiment of the impact piston.

The percussion drill shown by way of example has a generally tubular housing 1 the front end of which is formed as a stepped impact tip 1*a*. During the forward travel of the percussion boring device this impact tip 1*a* is acted on by an impact piston 2 which is axially displaceable within the housing 1 and is guided on the cylindrical inner surface of the housing 1 by portions thereof forming a front guide ring 2*a* and a rear guide ring 2*b*. The outside diameter of these guide rings 2*a* and 2*b*, which are formed in one piece with the impact piston 2, exceeds the outside diameter of the remaining part of the impact piston 2 so that an annular slot 3 is formed between the impact piston 2 and the housing 1. By means of recesses 2c formed in the front guide ring 2a, the annular slot 3 is in communication with the space in front of the end surface of the impact piston 2, as can be noted from FIGS. 1 and 2.

In order to secure the impact piston 2 against turning in the housing 1 upon its forward and backward axial movement, the impact piston 2 is provided with a longitudinal groove 2d into which a screw 4 arranged in the housing 1 engages. This structural feature can also be noted in FIG. 1 and in particular, in cross section, in FIG. 2.

The impact piston 2, which is guided in non-rotatable manner within the housing 1, is moved back and forth by compressed air, its impact action being exercised either on the impact tip 1a or on a bearing ring 5 which is fastened in the rear end of the tubular housing 1. If the impact piston 2 exerts its impact action on the impact tip 1a then the percussion boring devices moves in the forward direction. On the other hand, if the direction of impact of the impact piston 2 is reversed so that the force produced by the impact piston 2 acts on the bearing ring 5 then the percussion boring devices moves rearwardly, i.e. it moves out of the hole in the earth which has been previously formed.

The feeding of the compressed air and the change between forward and rearward travel are effected by a control sleeve 6 which is mounted in an axially non-displaceable but rotatable manner on the bearing ring 5. After rotation of the control sleeve 6 by an angle of rotation of about 90°, abutment stops or an automatically releasable lock assure that the control sleeve 6 is fixed in the desired rotated position. On the rear end of the control sleeve 6 extending out of the bearing ring 5 there is placed a compressed air hose 7 which the percussion boring devices pulls behind it upon its forward movement through the earth and which connects the housing 1 continuously with a source of compressed air, not shown. In order that the compressed air fed to the housing 1 can escape again, the bearing ring 5 has openings 5a through which compressed air can escape from the housing 1, the openings 5a communicating with the rear annular space in the housing 1 surrounding the control sleeve 6.

The control sleeve 6, shown in enlarged perspective view in FIG. 3, has at its front end a piston-like control head 6a which continuously extends complimentarily into a cylindrical recess 2e in the rear part of the impact piston 2. Within the region of this recess 2e at least one main control opening 8 and at least one additional control opening 9 are formed in the impact piston 2, these openings being staggered (offset) with respect to each other, at least in the circumferential direction of the impact piston 2. In the embodiment shown in FIGS. 1 to 7, two main control openings 8 which lie opposite each other and two additional control openings 9 which also lie opposite each other are provided in the impact piston, the additional control openings 9 being staggered in each case 90° in circumferential direction with respect to the main control openings 8.

These control openings 8 and 9 cooperate with control edges 10a, 11a which are formed on the control head 6a of the control sleeve 6. Each main control opening 8 has two pairs of control edges associated with it from time to time, one pair effecting the forward travel and one pair the return travel of the percussion drill boring device, depending on the rotated position of the control sleeve 6 if the boring device is being advanced or retracted, i.e. if the impact piston 2 impacts the front tip 1a or the bearing ring 5, respectively.

The pair 10 of control edges which effect the forward travel of the percussion boring device can be noted particularly clearly from FIG. 3. It comprises a front control edge 10a and a rear control edge 10b which is formed by the rear edge of the control head 6a of the control sleeve. Since two pairs 10 of control edges are present on the control head 6a due to the provision of two opposite main control openings 8, two front control edges 10a can be noted in FIG. 3.

Between the two pairs of control edges 10 in the preferred embodiment there are two pairs of control edges 11 for the return (rearward) travel of the percussion boring device. While the rear control edges 11b of this pair 11 of control edges are also formed by the common rear, and thus circumferentially developed, edge of the control head 6, its front control edge 11a is formed by a recess 6b extending from the forward edge of the control head 6a. In this way there result different distances of the front control edges 10a and 11a respectively from the rear control edges 10b and 11b respectively which lie in the same radial plane of the control sleeve 6.

The manner of operation of the control device described above will now be explained with reference to FIGS. 4 to 7.

Figure 4:
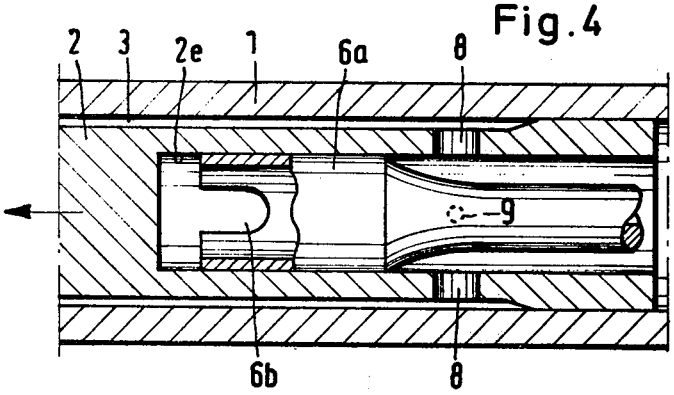
Figure 5:
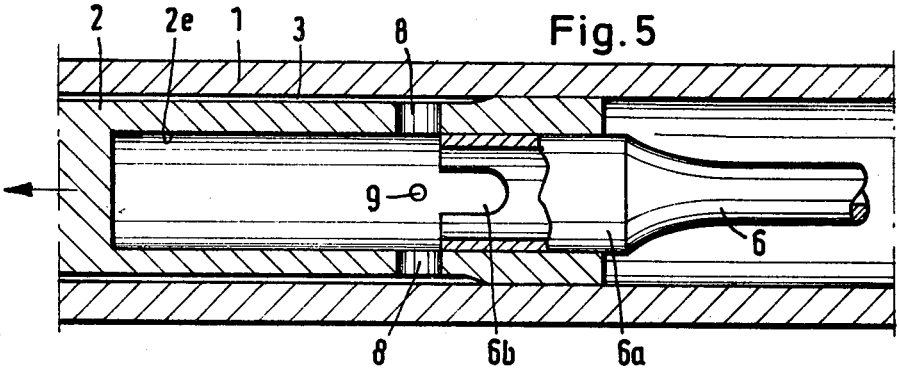
Figure 6:
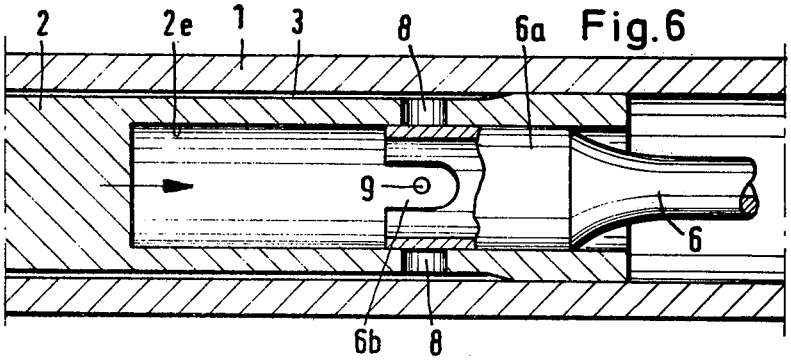

FIG. 4 shows the impact piston 2 in its rearmost position when the percussion boring device is driven in forward direction. In this position shown in FIG. 4, the forward movement of the impact piston 2 indicated by an arrow commences, since the compressed air fed by the control sleeve 6 flows into the cylindrical recess 2e within the rear end of the impact piston 2 and drives it accordingly forwardly with increasing speed in the direction towards the impact tip 1a of the housing 1. This forward drive of the impact piston 2 by the compressed air fed by means of the control sleeve 6 is interrupted only after the main control openings 8 of the impact piston 2, have moved over the front control edges 10a of the pair of control edges 10, shortly before the piston strikes the impact tip 1a, as shown in FIG. 5. From this point on, compressed air is conducted through the main control openings 8 via the annular slot 3 and through the recesses 2c onto the front end-surface of the impact piston 2 so that the impact piston 2, after its impact, is moved back by the compressed air into its rear end position shown in FIG. 4. The acceleration of the rearward movement of the impact piston 2 is continued even when, in accordance with FIG. 6, the main control openings 8 are already covered by the control head 6a since compressed air can still pass onto the front end surface of the impact piston 2 through the recesses 6b in the control head 6a by means of the additional control openings 9 again via the annular slot 3 and the recesses 2c. This can clearly be noted from FIG. 6 and, as compared with the prior art without additional control openings 9, causes a rearward shifting of the rear point of reversal of the movement of the impact piston 2 upon the commencement of forward travel of the percussion boring device. A longer stroke of the impact piston 2 thus occurs for the forward travel of the percussion drill so that, for the same dimensions and same pressure of the compressed air fed, the piston strikes with higher speed and thus higher impact energy on the impact tip 1a on the housing 1.

Since the flow cross-section of the additional control openings 9 is considerably smaller than the flow cross-section of the main control openings 8, only a small amount of compressed air passes out of the cylindrical recess 2*e* in the impact piston 2 into the annular slot 3 as a result of the premature uncovering of the additional control openings 9 upon the forward movement of the impact piston 2. This small amount, due in particular to the high velocity of the impact piston 2, does not have a braking action on the impact piston 2 since the latter has already struck the impact tip 1*a* before the compressed air emerging through the additional control openings 9 can build up a pressure on the front side of the impact piston 2.

In order to switch the percussion boring device from forward travel to backward travel, the control sleeve 6 is rotated 90° by means of the compressed air hose 7. In this way it comes into the position shown in FIG. 7. In this position the main control openings 8 cooperate with the other control edge pairs 11.

FIG. 7 shows that during such backward travel of the overall percussion boring device the forward movement of the impact piston 2 is already stopped prematurely before hitting the impact tip 1*a*, since the compressed air fed by the control sleeve 6 is already fed to the annular slot 3 via the openings 8 after reaching the rearward front control edge 11*a*. This compressed air, which comes onto the front end surface (not shown in FIGS. 4–7) of the impact piston 2, brakes the impact piston 2 before it strikes against the impact tip 1*a*. The piston then is rather accelerated in the opposite direction rearwardly and its rear annular surface strikes the bearing ring 5 with a certain momentum. In this way the entire percussion boring device is moved backward in the hole in the ground which has been previously bored. The additional control openings 9 do not have any effect upon the backward travel of the percussion boring device since during the forward movement of the impact piston 2 they pass over the front control edges 10*a* of the control edge pairs 10 which edges 10*a* are coordinated to the additional control openings 9 only after the main control openings 8 pass over the corresponding control edges 11*a* and vice versa during the rearward movement of the impact piston 2, and thus the additional control openings 9 have no effect on the backward travel of the percussion boring device. With the return travel of the overall boring device, during the forward movement of the impact piston 2 first the main control openings 8 interact with the control edges 11*a* and 11*b*. Only subsequently could action between the additional control openings 9 and the control edges 10*a* and 10*b* occur, in which operation, however, this effect is superfluous because the connection that was supposed to be made has already been established by means of the main control openings 8.

Finally, FIG. 8 shows a modified embodiment of the front control edge 11*a* of the control edge pair 11. This front control edge is composed of two control edge sections 12*a* and 12*b*, the control edge section 12*a* cooperating with a main control opening 8 (when the control sleeve is rotated in a position 90° from that illustrated in FIG. 8) and the control edge section 12*b* cooperating with the additional control opening 9 (as illustrated in the position of FIG. 8). In this way, the effect of the additional control opening 9 (here positioned different than 90° between the control openings 8) can be changed without it being necessary to tolerate at the same time a shift of the front control edge of the control edge pair 11 for the main control opening 8.

The embodiment shown in FIG. 8 shows that the control edge section 12*b* associated with the additional control opening 9 is at a lesser distance from the front control edge 10*a* of the control edge pair 10 than the control edge section 12*a* which cooperates with the main control openings 8 upon the backward travel of the percussion boring device. In this way the time interval during which the additional control openings 9 are active can be changed without at the same time changing the backward travel of the percussion boring device, which is dependent exclusively on the position of the control edge sections 12*a*. The same effect can be obtained by not arranging the additional control openings 9 in the same radial plane as the main control openings 8, as in the embodiments shown in FIGS. 1–8, but rather staggering them with respect to the main control openings 8 in the axial direction of the impact piston 2 (FIG. 9).

As shown in the drawings, the flow cross-section of the additional control openings 9 is considerably smaller than the flow cross-section of the main control openings 8. These main control openings 8 are about three to eight times larger than the additional control openings 9.

I claim:

1. In a control device for two working cycles of forward movement and rearward movement respectively of a self-propelled pneumatic ram boring device with an impact piston which is axially displaceable forwardly and rearwardly in a control stroke between two abutments, respectively impacting one of the abutments in each working cycle, in a generally tubular-shaped housing, whereby the axial forward movement and rearward movement of the ram boring device is controllable by control edges of a control sleeve, the latter being supported non-displaceably in the axial direction however rotatably on a bearing ring arranged in a rear part of the tubular-shaped housing, said control sleeve being connected to a compressed air hose and through which compressed air is fed to the impact piston driving the latter in its axially displaceable forward and rearward movement, and which sleeve has at its front end a piston-shaped control head containing the control edges, the control head engaging in a cylindrical recess at a rear end of the impact piston cooperates with at least one radial control opening which is formed in the impact piston in the vicinity of the recess, the control edges forming two different types of pairs of the control edges, each of said pairs having a front said control edge and a rear said control edge, said two different types of pairs being offset in the peripheral direction as well as in the axial direction relative to each other such that respectively in one rotated position of said control sleeve during operation of the ram boring device in each one of the two working cycles, respectively, only one of said two different type of pairs of the control edges is aligned cooperating with the control opening and the other of the two different type of pairs is not aligned with and does not cooperate with the control opening, and said impact piston being guided non-rotatably in the housing, the improvement wherein said control opening constitutes a main control opening, said impact piston is formed with at least one additional control opening which cooperates with said other pair of the control edges, said at least one additional control opening has a flow cross-section considerably smaller than that of the main control opening, and the rear control edges of both said pairs are formed in common by a rear circumferential edge of said control head.

2. The device as set forth in claim 1, wherein said main and said additional control openings are arranged in a common radial plane of the impact piston.

3. The device as set forth in claim 1, wherein said at least one additional control opening is staggered in axial direction with respect to the main control opening.

4. The device as set forth in claim 1, wherein the front control edge of the axially rearwardly offset pair is formed by a recess formed in and extending from a forward edge of the control head.

5. The device as set forth in claim 4, wherein the front control edge of the axially rearwardly offset pair has a first control edge section adapted to be aligned cooperating with the main control opening and a second control edge section adapted to be aligned cooperating with the additional control opening, respectively, said first and second control edge sections being staggered axially relative to each other.

6. The device as set forth in claim 1, wherein said at least one additional control opening is offset in the peripheral direction of the impact piston with respect to said main control opening.

7. The device as set forth in claim 1, wherein said rear circumferential edge of said control head forming said rear control edges of both said pairs is arranged in a common radial plane with respect to said control sleeve.

8. The device as set forth in claim 1, wherein said rear circumferential edge of said control head is circularly continuous.

9. The device as set forth in claim 1, including two of said at least one additional control opening offset in the peripheral direction substantially 180° relative to each other and two of said main control openings offset in the peripheral direction substantially 180° relative to each other, and two control edges of each said type of pairs disposed substantially 180° opposite each other.

10. The device as set forth in claim 1, including said at least one additional control opening is formed in the vicinity of said recess in the impact piston.

* * * * *